US006401588B1

(12) United States Patent
Atkinson et al.

(10) Patent No.: US 6,401,588 B1
(45) Date of Patent: Jun. 11, 2002

(54) DELIVERY OF EMULSION EXPLOSIVE COMPOSITIONS THROUGH AN OVERSIZED DIAPHRAGM PUMP

(75) Inventors: Kerry S. Atkinson, Lehi; John B. Halander, Murray, both of UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 09/505,841

(22) Filed: Feb. 17, 2000

(51) Int. Cl.[7] ..... F42B 3/00
(52) U.S. Cl. ..... 86/20.15
(58) Field of Search ..... 86/20.15; 102/313

(56) References Cited

U.S. PATENT DOCUMENTS 4,008,108 A * 2/1977 Chrisp ..... 149/2
4,259,977 A 4/1981 Brockington
4,273,147 A 6/1981 Olney
4,462,429 A 7/1984 Coursen
4,555,278 A 11/1985 Cescon et al.
4,615,752 A 10/1986 Miller
4,699,060 A * 10/1987 Vuillaume et al. ..... 102/313
4,966,077 A 10/1990 Halliday et al.
5,584,222 A * 12/1996 Engsbr.ang.ten et al. .. 86/20.15
5,686,685 A * 11/1997 McDonald et al. ..... 86/20.15
6,070,511 A * 6/2000 Palmer et al. ..... 86/20.15
6,125,761 A * 10/2000 Smith, Jr. et al. ..... 102/313
6,210,122 B1 * 4/2001 Brondbo ..... 417/55

* cited by examiner

*Primary Examiner*—Charles T. Jordan
*Assistant Examiner*—Jordan Lofdahl

(57) ABSTRACT

A system and method are provided for delivering emulsion explosive compositions into a borehole by means of an oversized diaphragm pump, which provides a relatively constant flow rate for the pumped emulsion explosive composition thereby minimizing flow pulsations during delivery.

14 Claims, 1 Drawing Sheet

DELIVERY OF EMULSION EXPLOSIVE COMPOSITIONS THROUGH AN OVERSIZED DIAPHRAGM PUMP

The present invention relates to a system and method for delivering emulsion explosive compositions (hereafter "emulsion compositions") into a borehole by means of an oversized diaphragm pump, which provides a relatively constant flow rate for the pumped emulsion composition thereby minimizing flow pulsations during delivery. More specifically, the system and method comprise an oversized diaphragm pump of significantly higher capacity than the intended flow rate of the emulsion composition, in combination with a water injection system that provides a lubricating annular stream of pressurized water between the pumped emulsion composition and the inner surface of a delivery hose for delivering the composition into a borehole. By minimizing flow pulsations, a safe, simple and easy to handle system and method for the delivery of emulsion compositions into boreholes are provided. Moreover, the diaphragm pump operates at a relatively low pressure which also enhances safety.

BACKGROUND OF THE INVENTION

The emulsion compositions of the present invention comprise water-in-oil emulsions that are used as explosives or blasting agents in mining or construction applications and are well known in the art. See, for example, U.S. Pat. No. 4,931,110. U.S. Pat. No. 5,686,685 ('685) discloses a simple system for the pneumatic delivery of emulsion explosives. After describing prior art methods for pumping emulsion explosives, the '685 patent discloses a system comprising a pressurized vessel for holding an emulsion explosive under pressure, which then is pneumatically discharged from the vessel and through a water injection system that provides an annular stream of pressurized water around the extruded emulsion explosive. Although this system satisfies safety concerns attendant other prior art pumping systems, which generally require higher pumping pressures and dynamic operations, the pressurized emulsion vessel is a relatively expensive and cumbersome piece of equipment. Further, a pressurized emulsion vessel, being of significant volume, increases the potential safety hazards associated with compressed gas systems.

In contrast, the system and method of the present invention retain the low pressure advantages of the '685 patent system, but utilize significantly less expensive equipment and particularly do not require an expensive, relatively large volume pressure vessel. Moreover, the flow rate of the emulsion composition in the present invention is surprisingly more constant and reliable during the repeated start-ups and shut-downs involved in borehole loading than that experienced with the '685 patent system. The oversized diaphragm pump is key to providing this constant flow rate.

SUMMARY OF THE INVENTION

The invention comprises an underground or surface delivery system for delivering emulsion compositions into a borehole further comprising:

(a) a bin for holding ail emulsion composition and having an outlet, (b) an oversized diaphragm pump connected to the bin outlet and to a power source for pumping the emulsion composition from the bin and through an outlet from the pump at a relatively constant flow rate thereby minimizing flow pulsations, (c) a water injector connected to the pump outlet for forming an annular stream of water around the emulsion composition, (d) a source of pressurized water for providing water to the water injector, (e) optionally, means for introducing trace gassing ingredients into the emulsion composition downstream from the diaphragm pump, and preferably upstream of the water injector, (f) a delivery hose extending from the water injector for delivering the emulsion composition into a borehole, and (g) optionally, a mixing device at or near the end of the delivery hose for mixing the optional trace gassing ingredients into the emulsion composition.

This delivery system is safe, simple and easy to handle and minimizes flow pulsations.

DETAILED DESCRIPTION OF THE INVENTION

Figure 1:
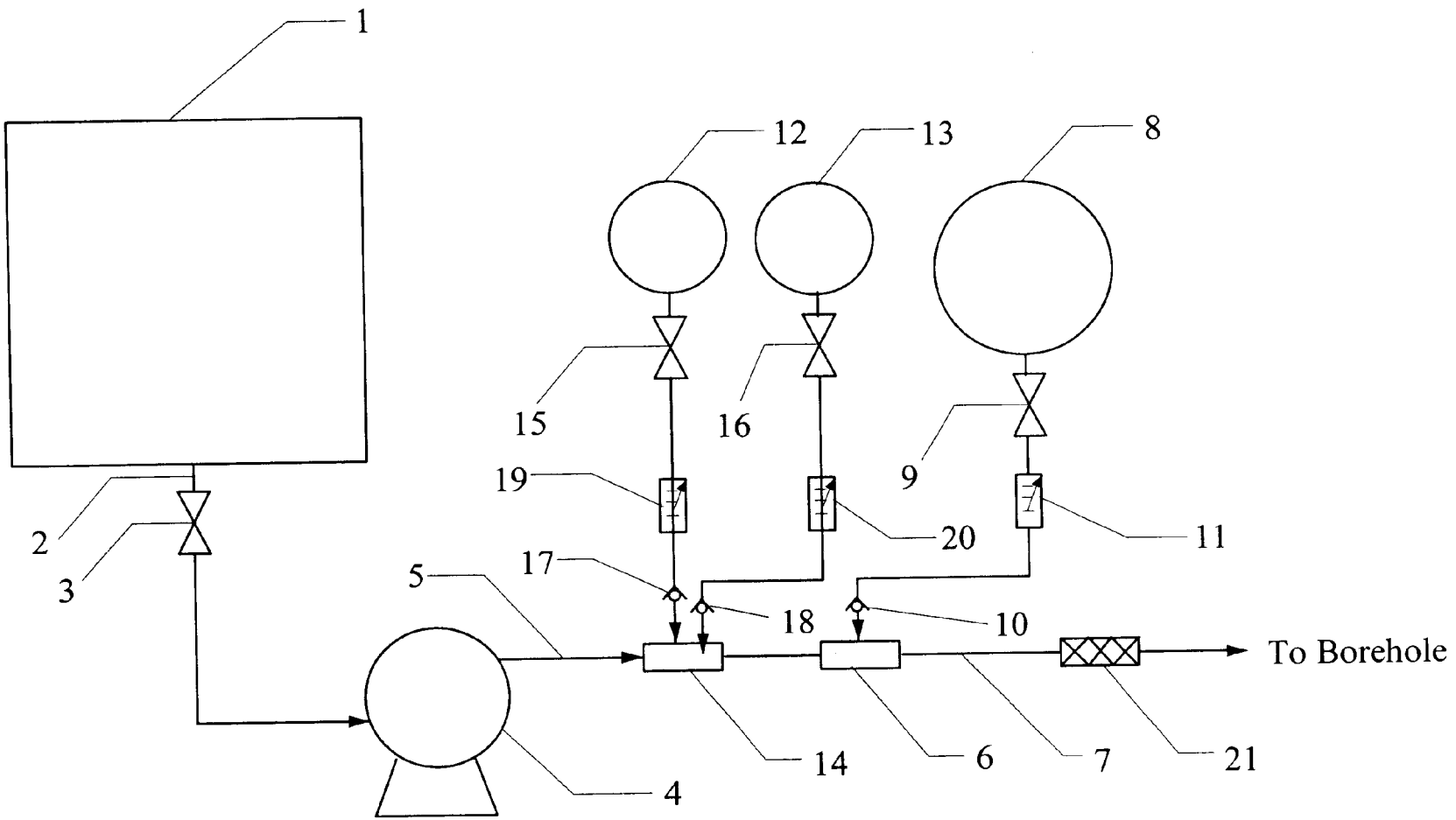
FIG. 1 is a flow diagram of the delivery system of the present invention.

Referring to FIG. 1, shown is a flow diagram of the emulsion delivery system of the present invention. An emulsion bin or hopper 1 for holding an emulsion composition has an outlet 2 connecting an oversized diaphragm pump 4 through on/off valve 3. The oversized diaphragm pump 4 is preferably a double diaphragm type as is well known in the art. Typical manufacturers of this pump type include Wildon, Yamada and Versa-Matic. By "oversized" is meant a diaphragm pump having a capacity of at least about three times greater than the intended flow rate of the delivered emulsion composition. Preferably, the emulsion composition flow rate from the diaphragm pump 4 fluctuates less than plus or minus 5% from its average flow rate so as to minimize flow pulsations.

The outflow line 5 from the diaphragm pump 4 ultimately enters a water injector 6. As is known in the art, the water injector 6 is adapted to form a thin annular sleeve of pressurized water around the emulsion composition as it exits the water injector 6. This sleeve of water lubricates the flow of the emulsion composition through a delivery hose 7 and into a borehole (not shown).

The source of pressurized water for the water injector 6 preferably is provided by a water tank 8. The water preferably is at a pressure of at least about 10 psi greater than the pressure of the diaphragm pump 4. Also shown are an on/off valve 9, check valve 10 and flowmeter 11.

Optionally, trace amounts of chemical gassing ingredients in trace tanks 12 and 13 are introduced into the emulsion stream via trace injection fitting 14 downstream from the diaphragm pump 4 and preferably upstream from the water injector 6, as shown. Also shown are on/off valves 15 and 16, check valves 17 and 18, and flow meters 19 and 20. The trace ingredients are mixed into the emulsion by an optional mixing nozzle 21 located at or near the end of the delivery hose 7. As is known in the art, chemical gassing ingredients preferably comprise an acidic solution and an aqueous solution of sodium nitrite that reacts chemically in the emulsion composition to produce gas bubbles. Preferably, a gassing accelerator such as thiocyanate is present in the emulsion composition to accelerate the gassing reaction. In addition to or in lieu of chemical gassing ingredients, hollow spheres made from glass, plastic or perlite may be added to provide density reduction and sensitization.

The present invention is further illustrated by the following examples.

EXAMPLE 1

A test was conducted wherein the underground delivery system of the present invention was operated to load underground boreholes with an emulsion explosive composition. A 180-gallon emulsion bin was charged with about 1800 pounds of emulsion composition having a viscosity of 23,000 cp. A 3-inch Versa-Matic oversized diaphragm pump was connected to an air supply pressure set at 90 psig. The pump inlet and outlet were 3 inches in diameter. A 10-gallon water tank and two 2-gallon trace gassing ingredient tanks were pressurized with air to 100 psig. Pressurized water was provided to a water injector at a rate of 2% by weight of the emulsion. The gassing ingredients were added at a rate of 0.5% by weight of the emulsion. The system was used to load a drift round comprising 55, 1.75-inch diameter by 8 feet deep, boreholes. The emulsion was pumped through 60 feet of a 0.75-inch diameter delivery hose at a rate of 65 pounds per minute. The initial emulsion density as 1.21 g/cc, and the emulsion was chemically gassed to a final cup density of 1.05 g/cc. Each hole required about 4–5 seconds to fill. The system was allowed to sit idle from 10 seconds to about 20 minutes between loading holes without compromising the water annulus. A short duration pulse or surge was experienced each time the diaphragm pump would stroke. On average a pulse or surge would occur every 1.9 holes.

EXAMPLE 2

A second test was conducted utilizing the system described in Example 1. The emulsion bin was charged and re-charged five times, each time with about 1500 pounds of emulsion at a viscosity of 29,000 cp. The oversized diaphragm pump supply pressure was 85 psig and the water injection pressure was set at 100 psig. The system was used to load a bench round consisting of 117, 2.5-inch diameter by 24 feet deep boreholes. The emulsion was pumped through 60 feet of 1.0-inch diameter delivery hose at a rate of 120 pounds per minute. Each hole required about 24–29 seconds to fill. The system was allowed to sit idle from 10 seconds up to about 20 minutes without compromising the water annulus. A short duration pulse or surge was experienced each time the diaphragm pump would stroke. On average a pulse or surge would occur 3.7 times per hole.

EXAMPLE 3

A third test was conducted utilizing the system described in Example 1. The emulsion bin was charged with about 1800 pounds of emulsion at a viscosity of about 33,000 cp. The oversized diaphragm pump supply pressure was set at 90 psig and the water tank was pressurized to 100 psig. The system was used to load a drift round comprised of 55, 1.75-inch diameter by 12 feet deep boreholes. The emulsion was pumped through 60 feet of 0.75-inch diameter delivery hose at a rate of 80 pounds per minute. Each hole required about 5–7 seconds to fill. The system was allowed to sit idle from 10 seconds up to about 20 minutes without compromising the water annulus. A short duration pulse or surge was experienced each time the diaphragm pump would stroke. On average a pulse or surge would occur every 1.2 holes.

In all of these examples, the rounds were loaded successfully at a constant and reliable flow rate, with minimal number and degree of pulsations and with low operating pressure.

While the present invention has been described with reference to certain illustrative examples and preferred embodiments, various modifications will be apparent to those skilled in the art and any such modifications are intended to be within the scope of the invention as set forth in the appended claims.

What is claimed is:

1. An underground or surface delivery system for delivering an emulsion explosive composition into a borehole comprising:

(a) a bin for holding an emulsion composition and having an outlet, (b) an oversized diaphragm pump having a capacity of at least about 3 times greater than the intended flow rate of the delivered emulsion composition, and being connected to the bin outlet and to a power source, for pumping the emulsion composition from the bin and through an outlet from the pump at a relatively constant flow rate thereby minimizing flow pulsations, (c) a water injector connected to the pump outlet for forming an annular stream of water around the emulsion composition, (d) a source of pressurized water for providing water to the water injector, and (e) a delivery hose extending from the water injector for delivering the emulsion composition into a borehole.

2. A system according to claim 1 wherein the diaphragm pump is pneumatic and the power source is pneumatic pressure.

3. A system according to claim 2 wherein the oversized diaphragm pump is a double diaphragm type.

4. A system according to claim 1 wherein the emulsion composition flow rate fluctuates less than plus or minus 5% from its average flow rate from the diaphragm pump.

5. A claim according to claim 1 wherein the source of pressurized water is at a pressure of at least about 10 psi greater than the pressure of the diaphragm pump.

6. A system according to claim 4 wherein the pressurized water is provided by a pressurized water tank.

7. A system according to claim 1 having a means for introducing trace gassing ingredients wherein the trace gassing ingredients are introduced into the emulsion composition after the composition has passed through the diaphragm pump but prior to the water injector.

8. A system according to claim 7 wherein a mixing device is placed in the delivery hose for mixing the trace ingredients and water into the emulsion composition prior to its delivery into a borehole.

9. A method for the delivery of an emulsion explosive composition into a borehole comprising:

(a) pneumatically pumping an emulsion composition through an oversized pneumatic diaphragm pump having a capacity of at least about 3 times greater than the intended flow rate of the emulsion composition, (b) injecting pressurized water as an annular stream around the emulsion composition following its exit from the diaphragm pump, and (c) delivering the emulsion composition through a delivery hose:and into a borehole, whereby the flow rate of the emulsion composition is relatively constant so as to minimize flow pulsations.

10. A method according to claim 9 wherein the pneumatic diaphragm pump is a double diaphragm type.

11. A method according to claim 9 wherein the water is injected at a pressure at least 10 psi greater than the pressure of the pumped emulsion composition.

12. A method according to claim 9 wherein the delivery hose has a mixing device for mixing trace gassing ingredients and water into the emulsion composition.

13. A method according to claim 9 wherein the emulsion composition flow rate fluctuates less than plus or minus 5% from its average flow rate from the diaphragm pump.

14. A method according to claim 9 wherein trace gassing ingredients are introduced into the emulsion composition prior to the injection of the pressurized water as an annular stream around the emulsion composition.

* * * * *